US006293058B1

(12) United States Patent
Sink

(10) Patent No.: US 6,293,058 B1
(45) Date of Patent: Sep. 25, 2001

(54) DRYWALL SUPPORT SYSTEM

(76) Inventor: Michael Sink, 105 E. Circle Dr., Summerville, SC (US) 29483

( * ) Notice: Subject to any disclaimer, the term of this patent is extended or adjusted under 35 U.S.C. 154(b) by 0 days.

(21) Appl. No.: 09/527,728

(22) Filed: Mar. 17, 2000

(51) Int. Cl.[7] ..... E02D 35/00; E04B 1/00; E04G 21/14

(52) U.S. Cl. ..... 52/127.1; 52/749.1; 52/747.1; 248/453; 248/316.8; 248/229.25; 242/129; 269/296

(58) Field of Search ..... 52/749.1, 747.1, 52/127.1, 127; 242/129; 248/453, 316.8, 229.25, 449, 125.1; 269/296, 76

(56) References Cited

U.S. PATENT DOCUMENTS

| | | | | |
|---|---|---|---|---|
| 2,584,293 | | 2/1952 | Sachs et al. . | |
| 2,861,765 | | 11/1958 | Kolb . | |
| 3,371,921 | | 3/1968 | Hollomon et al. . | |
| 4,068,427 | * | 1/1978 | Camardo | 52/127 |
| 4,167,255 | | 9/1979 | Benson . | |

* cited by examiner

*Primary Examiner*—Carl D. Friedman
*Assistant Examiner*—Chi Q Nguyen
(74) *Attorney, Agent, or Firm*—B. Craig Killough

(57) ABSTRACT

A support system of brackets and rods designed to be removably attached to a building stud. Used in pairs, the system can hold sheets of building material within the holing bracket and supported by a back rod so that the builder has the materials within easy view and reach and can replace partial sheets with the brackets.

13 Claims, 3 Drawing Sheets

DRYWALL SUPPORT SYSTEM

TECHNICAL FIELD

This invention relates to the field of support bracket systems, and particularly to a bracket, rod and holder combination which can be attached to a wooden building stud, and when two such combinations are employed, the device can be used to support building materials.

BACKGROUND OF THE INVENTION

One of the most irritating and time-consuming problems associated with the construction and finishing of a building is ready access to the materials needed. This need for efficiency becomes even more important when sizes smaller, or differently shaped than, the regularly issued sizes are needed. For example, drywall comes in 4'×8" sheets. In the drywalling of a room, frequently only a partial sheet, or a triangular sized section, is needed. Cutting a new sheet for the small size required is both inefficient and wasteful. Stopping work to rummage through odd fragments is also inefficient. A need exists for a simple to attach, simple to remove and relocate, support system which will enable the hanger or carpenter to place the sheets of drywall so that they are conveniently accessible to his or her work location, and to be able to replace partial sheets so they can also be easily located and essentially "recycled".

U.S. Pat. No. 3,271,921 to Divoky discloses a material holding bracket platform intended for holding plywood sheets intended to be used in the roofing of a building. The brackets are removably attached to two "lumber posts" which are leaned against the roof structure. Plywood sheets are then placed upon the brackets within the reach of the roofer.

SUMMARY OF THE INVENTION

The bracket and rod supporting system of the invention provides an easy to use support system for drywall or the like which is commonly used in construction. Upper and lower U-shaped brackets tighten around the exterior of a wooden building stud. A rod extends from the lower bracket to a trough shaped support holder. A back support rod extends from the support holder to the upper bracket. The resulting assembly has the overall configuration of a right angle triangle, with the stud as the vertical member. When two or more sets of brackets and rods are used, sheets of building material can be placed into the support holders. The sheets of building material rest against the back support rods. Thus, building materials can be placed in a position easily accessible to the user, who will not have to bend to the floor for more material. A special benefit of the system is that portions left after cutting up the original material can be replaced in the support system for efficient use when needed.

DESCRIPTION OF THE PREFERRED EMBODIMENT

In the detailed description of the drawings, like reference numbers are used on the different figures to refer to like parts. All brackets and rods are referred to in the plural, since a minimum of two are required to support the building materials. More than two sets may be used for exceptionally heavy or elongated materials.

Figure 1:
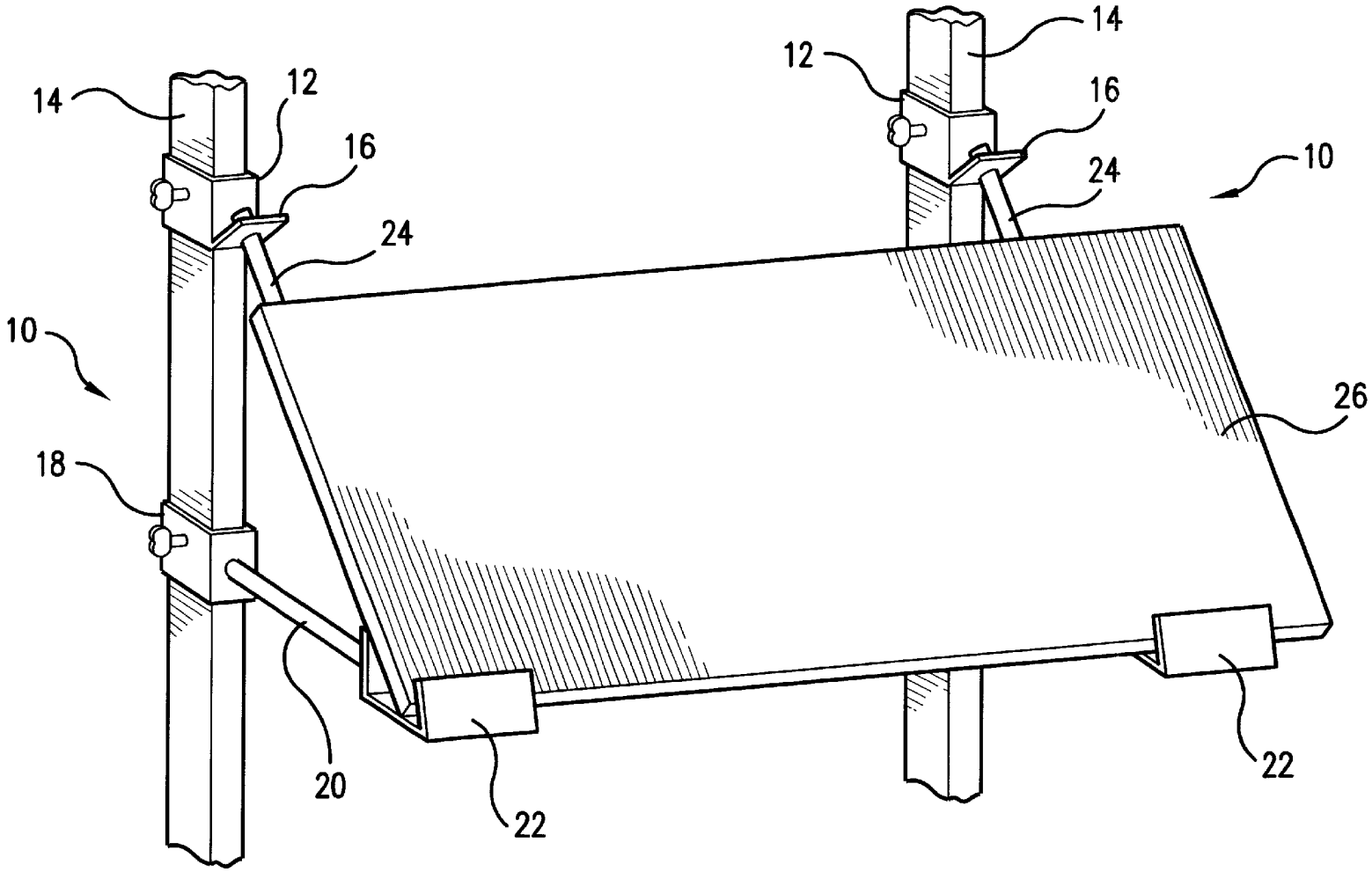
FIG. 1 is a generalized perspective drawing of the support system of the invention showing a sheet of drywall placed therein.

FIG. 1 shows the overall appearance of the bracket support system 10 in use. The bracket support system as shown has a sheet of drywall placed upon and within it. Upper brackets 12 are attached in a vertical orientation to studs 14 by means of conventional threaded screws which are inserted into holes, then inserted in upper bracket 12. In use, these screws are tightened against studs 14. At the lower ends of the upper brackets is a lip 16 which projects outward at an angle from the upper brackets. Lower brackets 18 are attached to the studs by fasteners such as the screws. From lower brackets 18 project lower connection rods 20 (only one set is visible in FIG. 1). Lower connection rods 20 are attached to support holders 22. Back support rods 24 connect lips 16 of the upper brackets to support the holder 22.

Figure 2:
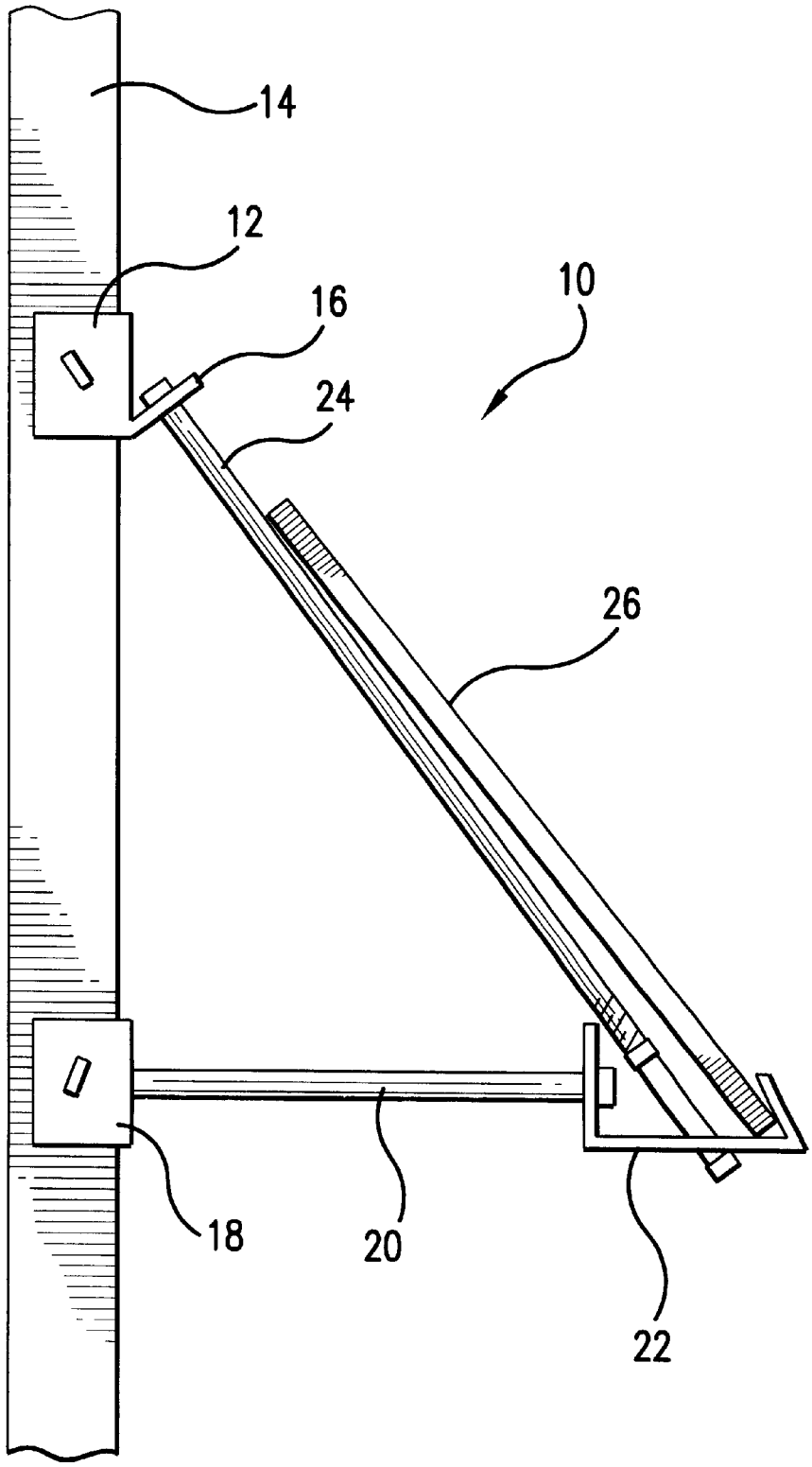
FIG. 2 is a side view of the support system showing a sheet of drywall placed therein.

FIG. 2 shows a side view of the bracket and rod system. All parts shown are the same as in FIG. 1.

Figure 3C:
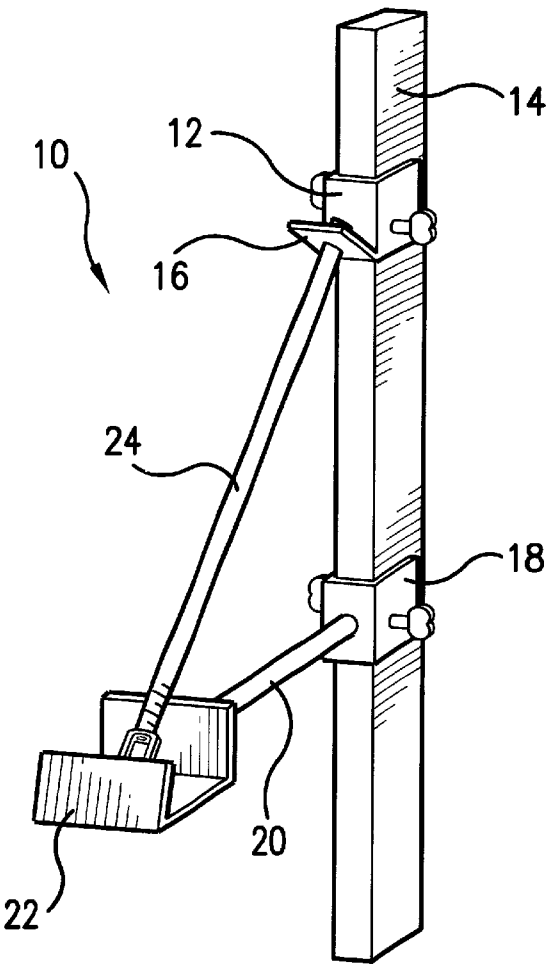
FIG. 3 is a close-up perspective drawing of the bracket system of the support system.
Figure 3B:
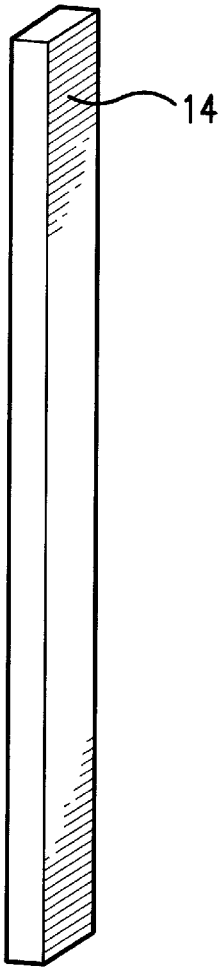
Figure 3A:
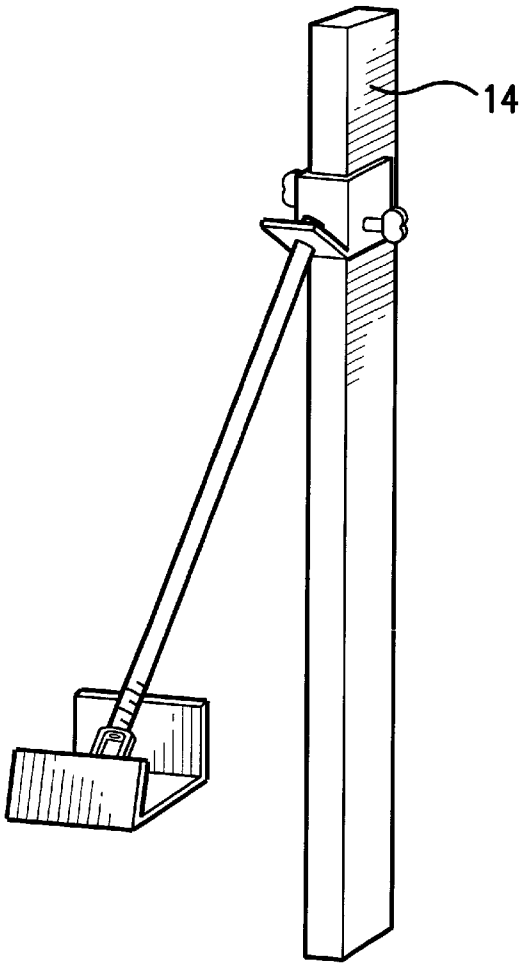

FIG. 3 shows a more detailed view of the bracket and rod system without the drywall in place. All parts are shown, with that exception, are the same as in FIG. 1.

In use, the device is attached to exposed building studs. The structure of the device is such that it may be attached at a height and location which is convenient to, and preferred by, the individual user. One or more sheets of drywall 26 is placed within and between the support holders. The drywall rests at a backward angle against back support rods 24. Pieces of drywall which are cut from sheets, but which are not used, may be staged within the support system for later use. Multiple pieces may be so held. The pieces are then available in one location at a work height which is convenient to the user, which are ready for the user. The system can also be used for holding sheets of plywood or other lengths of building materials.

The device will support substantial weight, which is necessary to use with a dense material like drywall. The support offered is sufficient to support multiple sheets of drywall.

What is claimed is:

1. A bracket support system, wherein a bracket support comprises:

a. an upper bracket configured to be attached to a building stud, said upper bracket having a first side and a second side, wherein an opening is formed on one end of said upper bracket to receive a building stud between said first side and said second side;

b. a lower bracket configured to be attached to a building stud, said lower bracket having a first side and a second side, wherein an opening is formed on one end of said lower bracket to receive a building stud between said first side and said second side;

c. a connection rod which extends from said lower bracket opposite said opening of said lower bracket;

d. a support holder which is connected to the connection rod, said support holder having a retainer thereon which is opposite said lower bracket; and e. a back support which extends from said upper bracket opposite said opening of said upper bracket and downwardly toward said support holder.

2. A bracket support system as described in claim 1, further comprising a second bracket support which comprises:

a. a second upper bracket configured to be attached to a building stud, said second upper bracket having a first side and a second side, wherein an opening is formed on one end of said second upper bracket to receive a building stud between said first side and said second side of said second upper bracket;

b. a second lower bracket configured to be attached to a building stud, said second lower bracket having a first side and a second side, wherein an opening is formed on one end of said second lower bracket to receive a building stud between said first side and said second side of said second lower bracket;

c. a connection rod which extends from said second lower bracket opposite said opening of said second lower bracket;

d. a support holder which is connected to said connection rod which extends from said second lower bracket, said support holder which is connected to said connection rod which extends from said second lower bracket having a retainer thereon which is opposite said second lower bracket; and e. a back support which extends from said second upper bracket opposite said opening of said second upper bracket and downwardly toward said support holder which is connected to said connection rod which extends from said second lower bracket;

wherein said back support which extends from said second upper bracket is positioned generally parallel to said back support which extends from said upper bracket.

3. A bracket support system as described in claim 1, wherein at least one of said upper bracket and said lower bracket comprises means for applying a force to a building stud to hold said bracket support in place relative to a building stud.

4. A bracket support system as described in claim 2, wherein at least one of said second upper bracket and said second lower bracket comprises means for applying a force to a building stud to hold said second bracket support in place relative to a building stud.

5. A bracket support system according to claim 3 wherein the means for applying a force to a building stud to hold said bracket support in place relative to a building stud is at least one screw.

6. A bracket support system according to claim 4 wherein the means for applying a force to a building stud to hold said second bracket support in place relative to a building stud is at least one screw.

7. A bracket support system according to claim 1 wherein said upper bracket comprises a lip that projects from said upper bracket, and wherein said back support extends from said lip.

8. A bracket support system according to claim 2 wherein said second upper bracket comprises a lip that projects from said second upper bracket, and wherein said back support extends from said lip of said second upper bracket.

9. A bracket support system according to claim 3 wherein said upper bracket comprises a lip that projects from said upper bracket, and wherein said back support extends from said lip.

10. A bracket support system according to claim 4 wherein said second upper bracket comprises a lip that projects from said second upper bracket, and wherein said back support extends from said lip of said second upper bracket.

11. A method of supporting sheets of building material, the method comprising:

removably attaching to a pair of building studs, a pair of bracket support systems, each bracket support system comprising: an upper bracket and lower bracket both configured to fit around one building stud of said pair of building studs, a support holder configured to hold one side of a sheet of building material, an extension rod connecting the lower bracket to the support holder, and a support rod extending from the support holder to the upper bracket to form a back rest for the sheets of building material, and placing the sheets of building material within the pair of support holders, so that the sheets rest against the support rods of the bracket support system.

12. A method of supporting sheets of building material according to claim 6 wherein the means for removably attaching the upper and lower brackets to the pair of building studs are screws inserted through holes in the brackets.

13. A method of supporting sheets of building material according to claim 6 wherein the means for removably attaching the upper and lower brackets to the pair of building studs comprises a plurality of threaded holes cut through the upper and lower brackets in a matching plurality of threaded screws.

* * * * *